US007121681B2

(12) United States Patent
Cull et al.

(10) Patent No.: US 7,121,681 B2
(45) Date of Patent: Oct. 17, 2006

(54) COMPACT HIGH-BRIGHTNESS FLUORESCENT LAMP SYSTEM

(75) Inventors: Brian D. Cull, Glendale, AZ (US); Allen E. Harris, Phoenix, AZ (US); Elias S. Haim, Glendale, AZ (US); Danny Lee Heath, Jr., Peoria, AZ (US)

(73) Assignee: Honeywell International, Inc., Morristown, NJ (US)

( * ) Notice: Subject to any disclaimer, the term of this patent is extended or adjusted under 35 U.S.C. 154(b) by 106 days.

(21) Appl. No.: 10/781,098

(22) Filed: Feb. 17, 2004

(65) Prior Publication Data

US 2005/0083695 A1 Apr. 21, 2005

Related U.S. Application Data

(60) Provisional application No. 60/510,463, filed on Oct. 10, 2003.

(51) Int. Cl.
*F21V 7/10* (2006.01)
*F21K 27/00* (2006.01)

(52) U.S. Cl. ..... 362/216; 362/260; 313/493

(58) Field of Classification Search ..... 362/216, 362/260, 812; D26/3; 313/634, 573, 493, 313/483, 484, 25

See application file for complete search history.

(56) References Cited

U.S. PATENT DOCUMENTS 4,772,819 A * 9/1988 Ridders ..... 313/493
4,786,841 A * 11/1988 Fohl et al. ..... 313/493
D303,157 S * 8/1989 Misono et al. ..... D26/3
4,853,591 A * 8/1989 Klein et al. ..... 313/493
D304,241 S * 10/1989 Kamei et al. ..... D26/3
5,253,151 A * 10/1993 Mepham et al. ..... 362/216
D349,969 S * 8/1994 Yang ..... D26/3
D390,674 S * 2/1998 Foo ..... D26/3
5,719,465 A * 2/1998 Den Breeijen et al. ..... 313/490
5,739,633 A * 4/1998 Biro et al. ..... 313/490
5,775,801 A * 7/1998 Shaffer ..... 362/310
5,801,484 A * 9/1998 Bankuti et al. ..... 313/493
D406,908 S * 3/1999 Foo ..... D26/3
D410,555 S * 6/1999 Soo ..... D26/3
D413,398 S * 8/1999 Foo ..... D26/3
D432,687 S * 10/2000 Choi ..... D26/3
D438,652 S * 3/2001 Foo ..... D26/3
D463,870 S * 10/2002 Foo ..... D26/3
D471,296 S * 3/2003 Bobel ..... D26/3
D471,297 S * 3/2003 Bobel ..... D26/3
D471,298 S * 3/2003 Bobel ..... D26/3
D473,329 S * 4/2003 Foo ..... D26/3
D480,161 S * 9/2003 Foo ..... D26/3
D488,874 S * 4/2004 Li ..... D26/3
6,762,549 B1 * 7/2004 Hitzschke et al. ..... 313/493

* cited by examiner

*Primary Examiner*—Sandra O'Shea
*Assistant Examiner*—Jacob Y. Choi
(74) *Attorney, Agent, or Firm*—Ingrassia Fisher & Lorenz

(57) ABSTRACT

A fluorescent lamp system is provided that facilitates high-brightness in a compact size needed for liquid crystal displays. The fluorescent lamp system comprises a lamp having a plurality of interdigitated legs arranged in multiple planes. By arranging the interdigitated legs in multiple planes, the lamp system efficiently fills the available space, thus maximizing the lamp surface area in general, and the lamp surface area oriented toward the display in particular, all while maintaining relatively small overall dimensions. The lamp system is thus able to provide the high-brightness needed for displays in a compact size.

12 Claims, 22 Drawing Sheets

400

600

COMPACT HIGH-BRIGHTNESS FLUORESCENT LAMP SYSTEM

CROSS-REFERENCE TO RELATED APPLICATOIN

This application claims the benefit of U.S. Provisional Application No. 60/510,463 filed Oct. 10, 2003.

FIELD OF THE INVENTION

This invention generally relates to fluorescent lamp systems, and more specifically applies to fluorescent lamp systems for back-lighting displays.

BACKGROUND OF THE INVENTION

Various types of optical displays are commonly used in a wide variety of applications. Included among these various types of displays Liquid Crystal Displays (LCDs). LCDs are typically direct view displays or projection displays. In the direct view approach the image is created and viewed directly on the LCD with a light source opposite the view side. In the projection approach, this LCD image is projected through an optical lens system on to a screen. In the case of a rear projection TV the image is projected on to a diffuse screen. In the case of a Head Up Display (HUD), the image is projected on a partially reflective screen.

One important performance parameter in projection displays in general, and HUDs in specific, is the range of luminance that can be provided by a projection display. In many applications it is critical that a display make information clearly visible in a wide variety of ambient light conditions. For example, a display used in an avionics system will need to display information to the pilot under lighting conditions that can range from near total blackness to the extreme glare created by facing directly into daytime sunlight. Thus, a display used in an avionics system must have the ability to provide a high brightness image. Without a sufficiently high brightness, a viewer of the display may be unable to easily read information from the display in high ambient light conditions. An additional challenge for the HUD type displays is the image is only partially reflected on a see-through screen. This partial reflection maybe only 15% of the projected image, hence placing higher brightness requirements on the display backlight.

To achieve high brightness is projection displays previous systems have relied upon high energy lamps such as high pressure arc lamps. While high pressure arc lamps provide high brightness, they can also generate significant heat. This heat must be dissipated away from components or it can interfere with their reliable operation. To dissipate this heat, significant area may be required to provide heat sinks or another heat transfer path away from critical components. Additionally, high pressure arc lamps may have increased explosion potential when seals rupture and have difficulty in dimming over a wide range. Thus, the use of high pressure arc lamps can be undesirable where the size of the display is limited, and where reliability and safety is a primary concern Accordingly, it is desirable to provide an improved lamp system that can provide high luminance output in a compact size for use in LCD displays. Furthermore, other desirable features and characteristics of the present invention will become apparent from the subsequent detailed description and the appended claims, taken in conjunction with the accompanying drawings and the foregoing technical field and background.

BRIEF SUMMARY OF THE INVENTION

The present invention provides a fluorescent lamp system that facilitates high-brightness in a compact size needed for display systems such as head up displays. The fluorescent lamp system comprises a lamp having a plurality of interdigitated legs arranged in multiple planes. By arranging the interdigitated legs in multiple planes, the lamp system efficiently fills the available space, thus maximizing the lamp surface area in general, and the lamp surface area oriented toward the display in particular, all while maintaining relatively small overall dimensions. The lamp system is thus able to provide the high-brightness needed for HUDs in a compact size.

In one embodiment, the fluorescent lamp system comprises a spiral, or tilted serpentine configuration. In the spiral lamp configuration, successive legs alternate between planes. This allows successive legs to be adjacent and fill the lamp area oriented toward the display, thus maximizing the lamp surface area provided to the display.

In another embodiment, the fluorescent lamp system comprises a folded lamp configuration. In the folded lamp configuration, adjacent legs are in the same plane, with a transition from one plane to the next made between at least one set of legs. In this embodiment, the legs are interdigitated with legs in another plane, to again fill the lamp area oriented toward the display.

In another embodiment, the fluorescent lamp system comprises a lamp having a plurality of interdigitated legs arranged in multiple curved planes.

In other embodiments, one or more legs are formed with apertures in the lamp legs to increase the light directed toward the display.

BRIEF DESCRIPTION OF DRAWINGS

The preferred exemplary embodiment of the present invention will hereinafter be described in conjunction with the appended drawings, where like designations denote like elements, and.

DETAILED DESCRIPTION OF THE INVENTION

The present invention provides a fluorescent lamp system that facilitates high-brightness in a compact size needed for projection display systems such as head up displays. For a fluorescent light to produce the high brightness required for some applications, it's surface area (and resulting phosphor coating area) should be maximized for the given volume. To maximize life and minimize cost, weight and electrical drive complexity it is generally desirable to use a single lamp to illuminate the display. The embodiments of the present invention provide lamp geometries and cross-sections which can be used to provide high brightness in a compact volume, while maintaining the simplicity of using a single lamp.

The fluorescent lamp system comprises a lamp having a plurality of interdigitated legs arranged in multiple planes. By arranging the interdigitated legs in multiple planes, the lamp system efficiently fills the available space, thus maximizing the lamp surface area in general, and the lamp surface area oriented toward the display in particular, all while maintaining relatively small overall dimensions. The lamp system is thus able to provide the high-brightness needed for HUDs and other displays in a compact size.

In one embodiment, the fluorescent lamp system comprises a spiral, or tilted serpentine configuration. In the spiral lamp configuration, successive legs alternate between planes. This allows successive legs to be adjacent and fill the lamp area oriented toward the display, thus maximizing the lamp surface area provided to the display.

In another embodiment, the fluorescent lamp system comprises a folded lamp configuration. In the folded lamp configuration, adjacent legs are in the same plane, with a transition from one plane to the next made between at least one set of legs. In this embodiment, the legs are interdigitated with legs in another plane, to again fill the lamp area oriented toward the display. In another embodiment, the fluorescent lamp system comprises a lamp having a plurality of interdigitated legs arranged in multiple curved planes. In other embodiments, one or more legs are formed with apertures in the lamp legs to increase the light directed toward the display.

Turning now to FIGS. 1, 2, 3 and 4 a perspective view, front view, side view and bottom view of a first embodiment fluorescent lamp 100 is illustrated. In this embodiment, the fluorescent lamp 100 comprises a plurality of legs 102 and a plurality of curved segments 104. The plurality of legs 102 is arranged such that a first set of legs resides in a first plane and a second set of legs resides in a second plane. In this embodiment, a first successive set of six legs is in the first plane, and a second successive set of five legs is in the second plane, with the first plane substantially parallel to the second plane.

Figure 1:
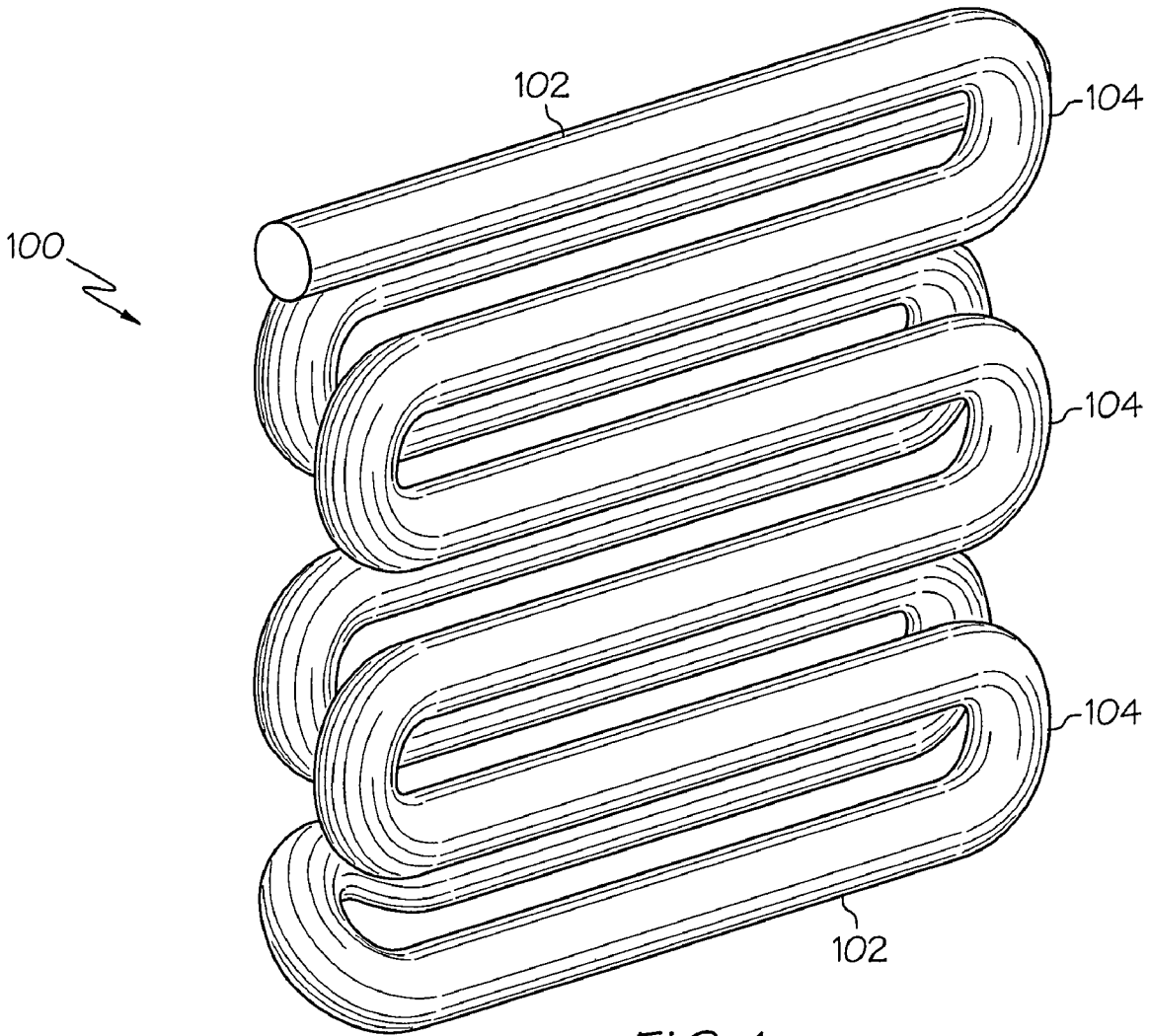
FIG. 1 is a perspective view of a first embodiment fluorescent lamp.
Figure 2:
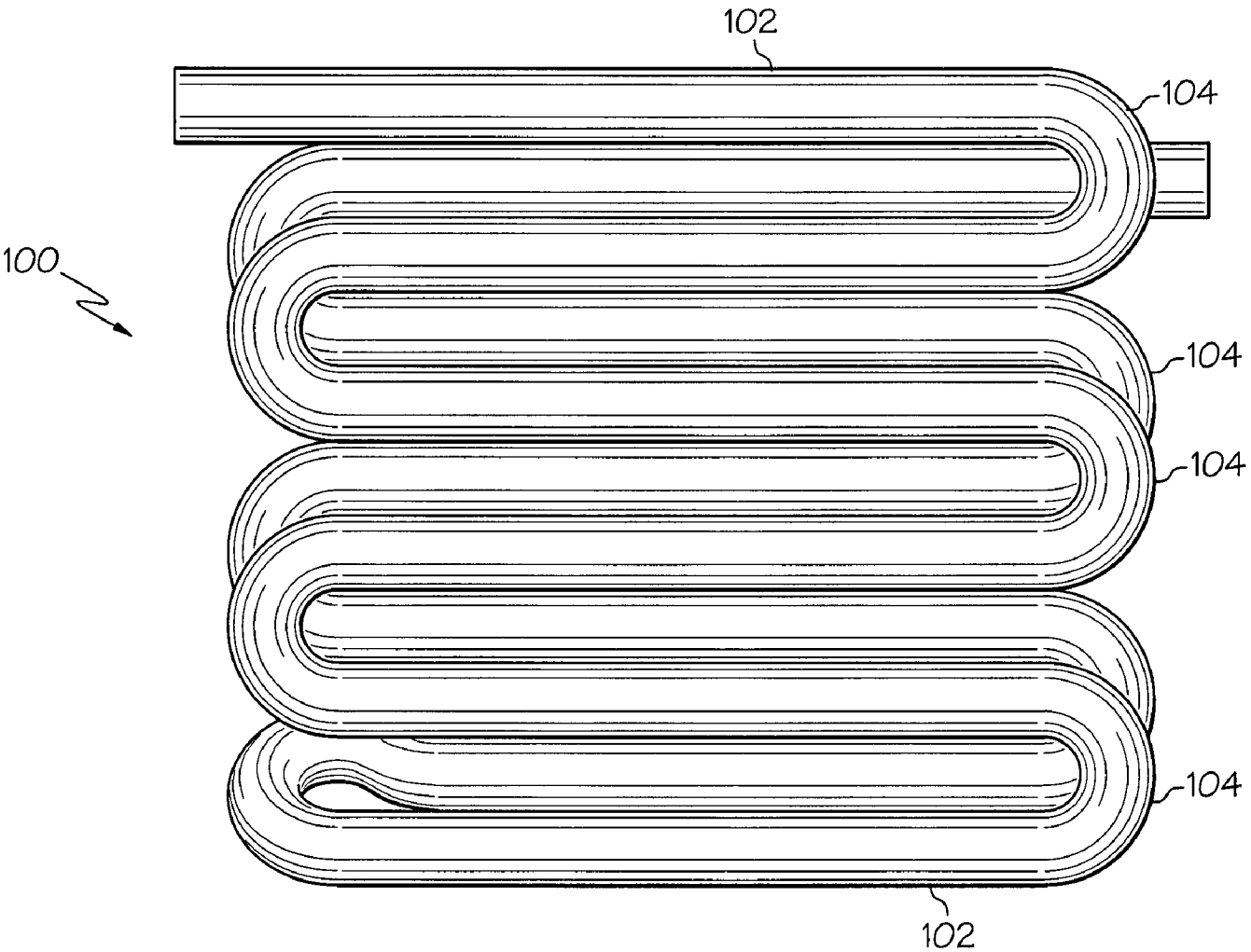
FIG. 2 is a front view of a first embodiment fluorescent lamp.
Figure 3:
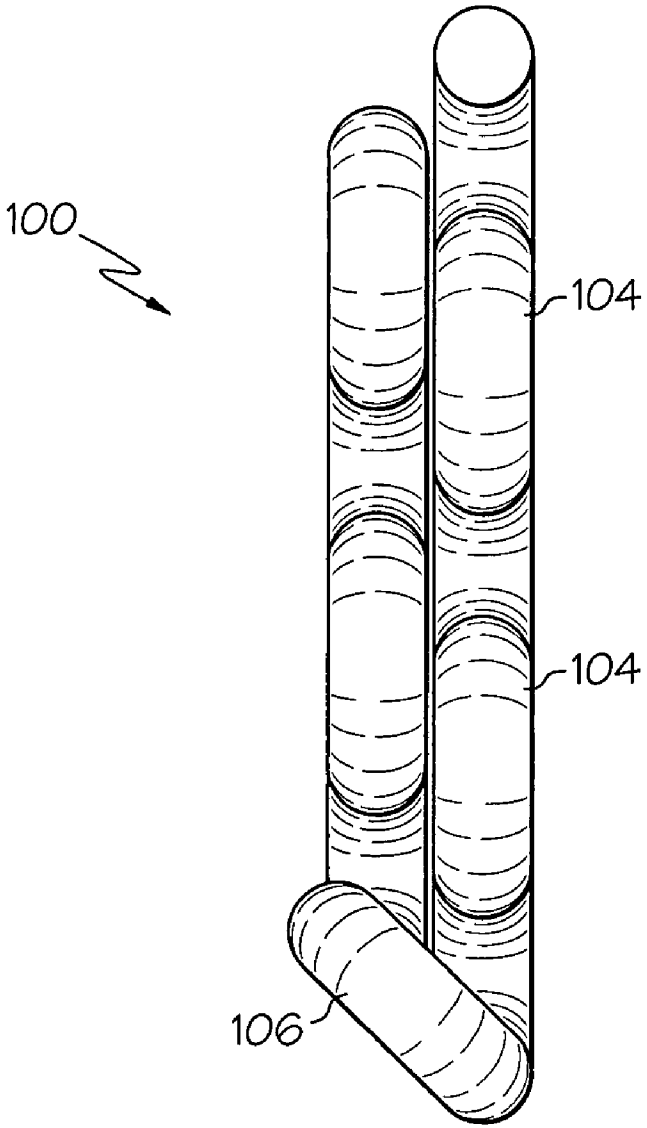
FIG. 3 is a side view of a first embodiment fluorescent lamp.
Figure 4:
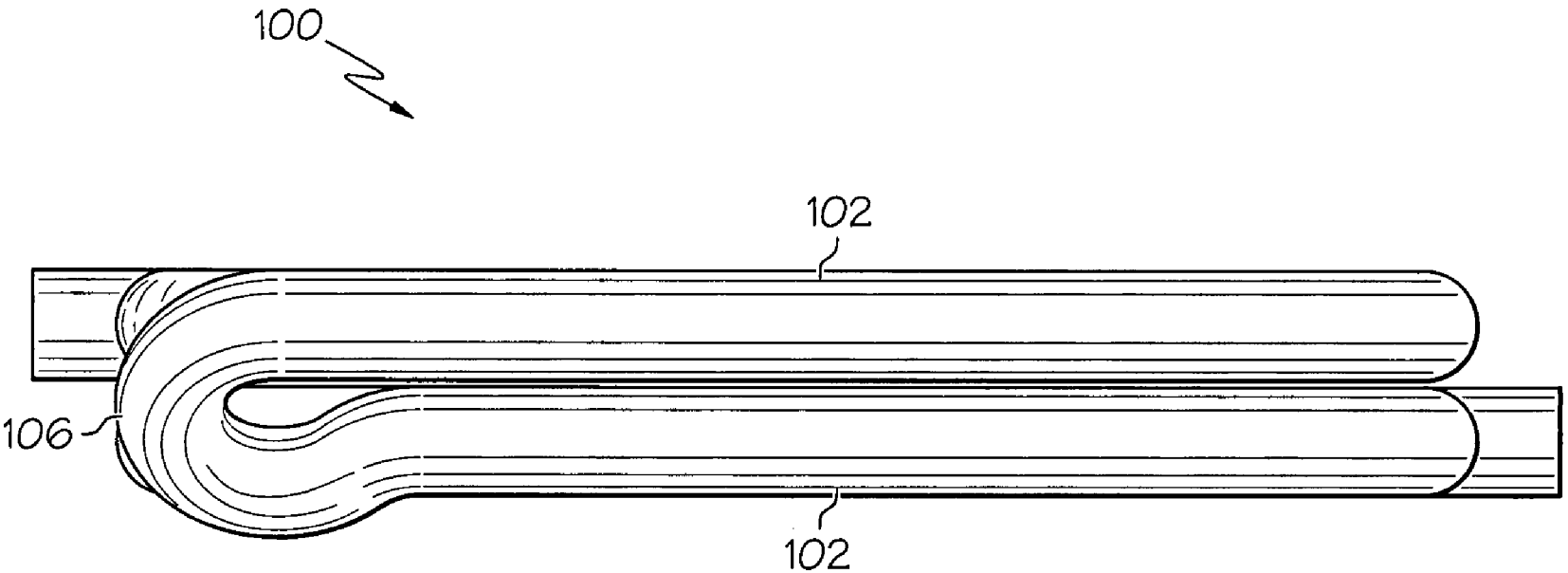
FIG. 4 is a bottom view of a first embodiment fluorescent lamp.

As can be seen from the front view illustrated in FIG. 2, the plurality of legs in the first plane are interdigitated with the plurality of legs in the second plane. This results a lamp structure that provides a continuous lamp surface facing the front view of the lamp. This increased surface area of the can provide increased luminance in a relatively small sized lamp. As illustrated in FIG. 4, one curved segment 106 serves as the transition segment between the legs in the first plane and the legs in the second plane. Other embodiments could include more than two planes of lamp. Not shown in these figures are the cathodes, which would typically be placed at the ends of the tubular lamp.

In a further variation on this embodiment, the tubular fluorescent lamp 100 can be formed as an aperture lamp. In general, aperture lamps are a type of fluorescent lamp having an internal slit aperture to concentrate and direct the emitted light into a narrow angular range. As one example, one or more of the legs 102 and curved segments 104 can be formed with apertures on the front side of the lamp to preferentially direct light in the desired direction, typically toward the imaging source in the display.

Aperture lamps can typically be formed using the same basic structure as a typical tubular fluorescent lamp. In typical tubular fluorescent lamps the lamp comprises a hollow glass tube having a phosphor coating on the entire inside. To form an aperture lamp, the phosphor coating is omitted in one narrow region that forms the "aperture" of the aperture lamp. As with typical lamps, the center of the tube is filled with a mixture of gases which, when exited by an electric current supplied by electrodes at the ends of the tube, emits ultraviolet light. The ultraviolet light, in turn, strikes the phosphor coating and is converted to visible light. Because typical phosphor coatings act as a diffuse reflector, the majority of incident light is scattered back into the lamp, while most of the light not reflected is transmitted through the phosphor coating. The aperture in the phosphor coating creates an exit point for the light, and thus the aperture causes the light to be directed preferentially out the aperture.

One limitation in this type of aperture lamp is due to relatively low reflectively and high absorption of the phosphor coating. Typically, the phosphor coating is relatively thin, resulting in poor reflectivity (e.g., between 60 and 80%). This can result in a significant portion of light escaping the lamp in areas other than the aperture. This unwanted transmission of light through the coating can significantly reduce the effectiveness of the aperture lamp.

To improve the effectiveness of the aperture lamp, some implementations add an additional reflective coating inside the lamp. In these embodiments, the reflective coating is typically added to the inside of the glass tube in all areas except in the narrow region where the phosphor is omitted to form the aperture. The addition of the reflective coating improves the effectiveness of this lamp by increasing the amount of light that exits the lamp through the aperture, and decreasing the amount of light that exits the lamp at other areas. This improvement generally comes at a cost of increased manufacturing difficulty and the resulting cost.

Figure 5:
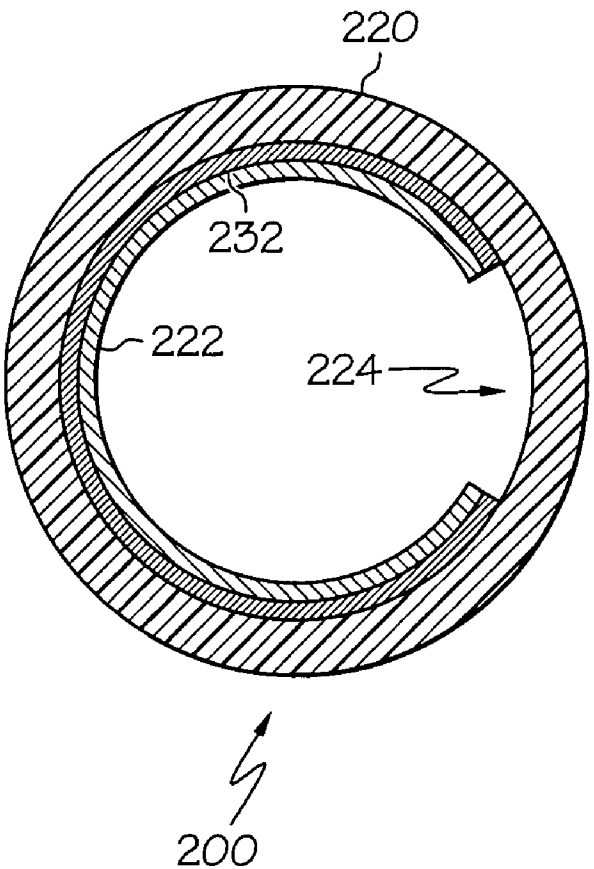
FIG. 5 is a cross sectional view of an aperture lamp.
Figure 5:
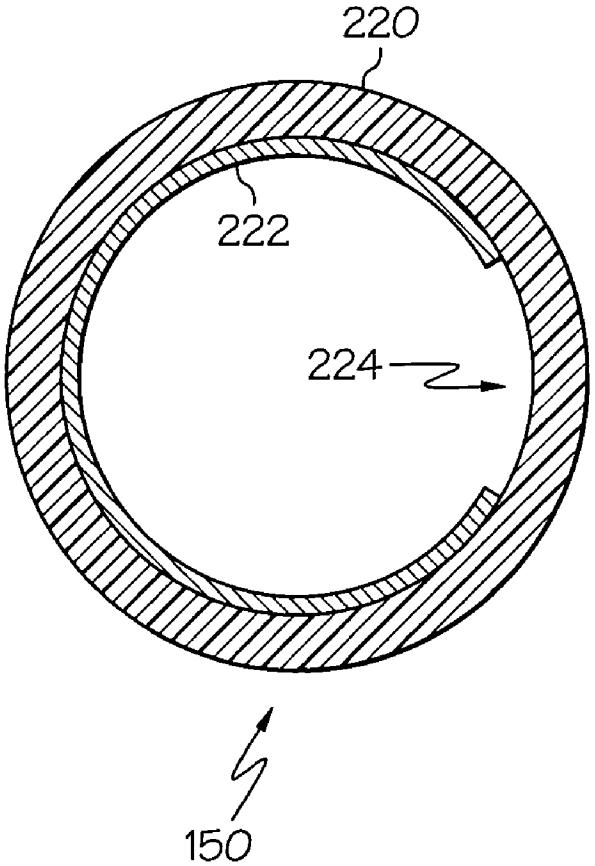
Figure 6:
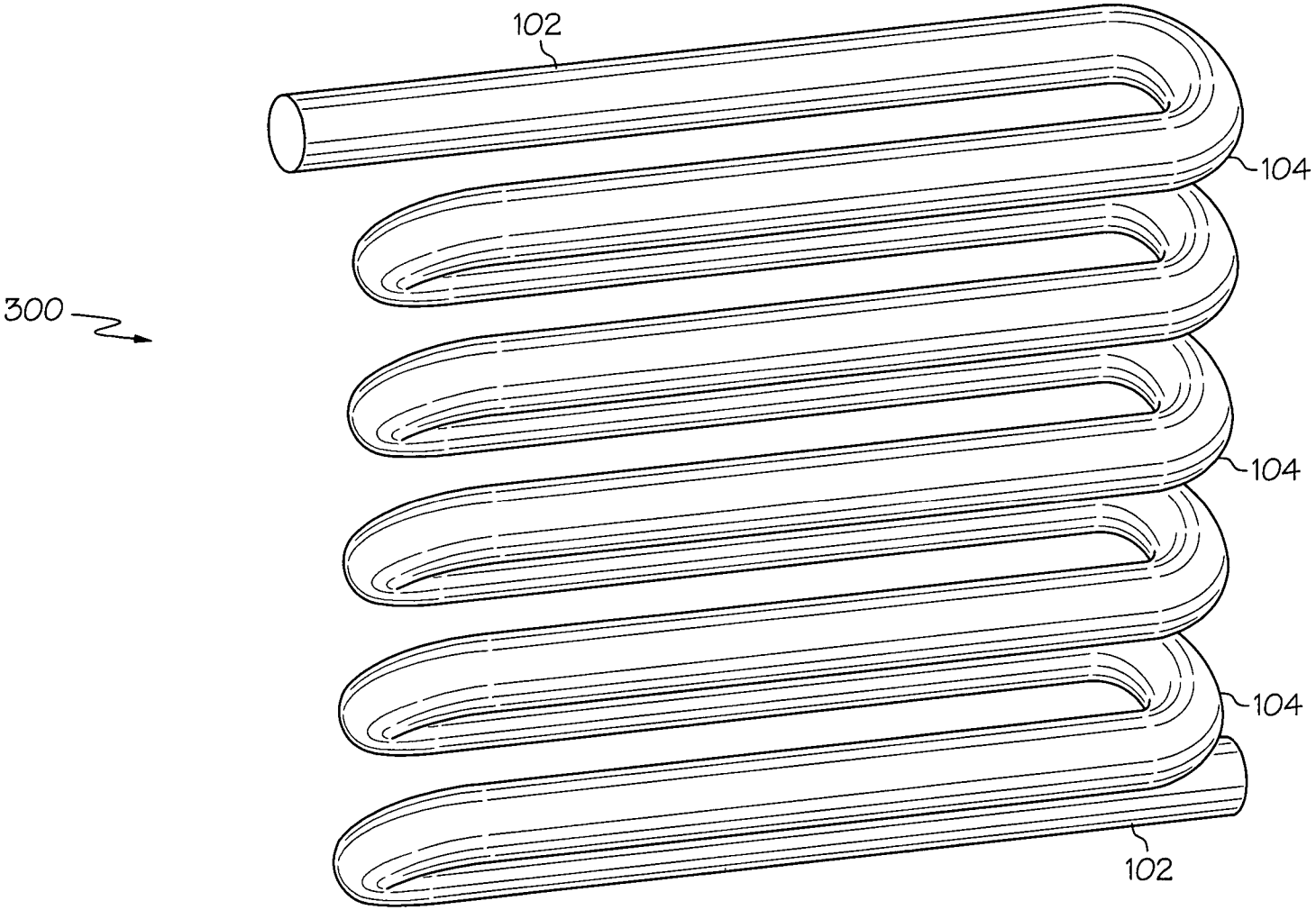
FIG. 6 is a perspective view of a second embodiment fluorescent lamp.

Turning now to FIG. 5, a cross-sectional view of a first exemplary aperture lamp 150 and a second exemplary lamp 200 is illustrated. Both aperture lamps 150 and 220 include a hollow glass tube 220 having a phosphor coating 222 on the entire inside surface except in a first narrow region that forms an aperture 224. Each hollow glass tube would typically be filled with a mixture of gases which, when exited by an electric current supplied by cathodes that include electrodes (not shown) at the ends of the tube, emits ultraviolet light. The ultraviolet light, in turn, strikes the phosphor coating and is converted to visible light.

As stated above, some lamp systems add reflective coatings inside the lamp surface to improve the effectiveness of the lamp. In these embodiments, the reflective coating is typically added to the inside of the glass tube in all areas except in the narrow region where the phosphor is omitted to form the aperture. The aperture lamp 200 includes a reflective coating 232 added between the hollow glass tube 220 and the phosphor coating 222. This reflective coating 232 is formed covers the interior of the glass tube 220 except in the first narrow region that forms aperture 224. The addition of the reflective coating 232 improves the effectiveness of the lamp 200 lamp by increasing the amount of light that exits the lamp through the exit aperture 224, and decreasing the amount of light that exits the lamp at other areas.

Turning now to FIGS. 6, 7, 8 and 9 a perspective view, front view, side view and bottom view of a second embodiment fluorescent lamp 300 is illustrated. In this embodiment, the fluorescent lamp 300 again comprises a plurality of legs 102 and a plurality of curved segments 104. The plurality of legs 102 is arranged such that successive legs in the plurality of legs alternate between a first plane and a second plane, with the first plane substantially parallel to the second plane. Furthermore, the plurality of legs 102 are arranged substantially parallel with each other.

Figure 7:
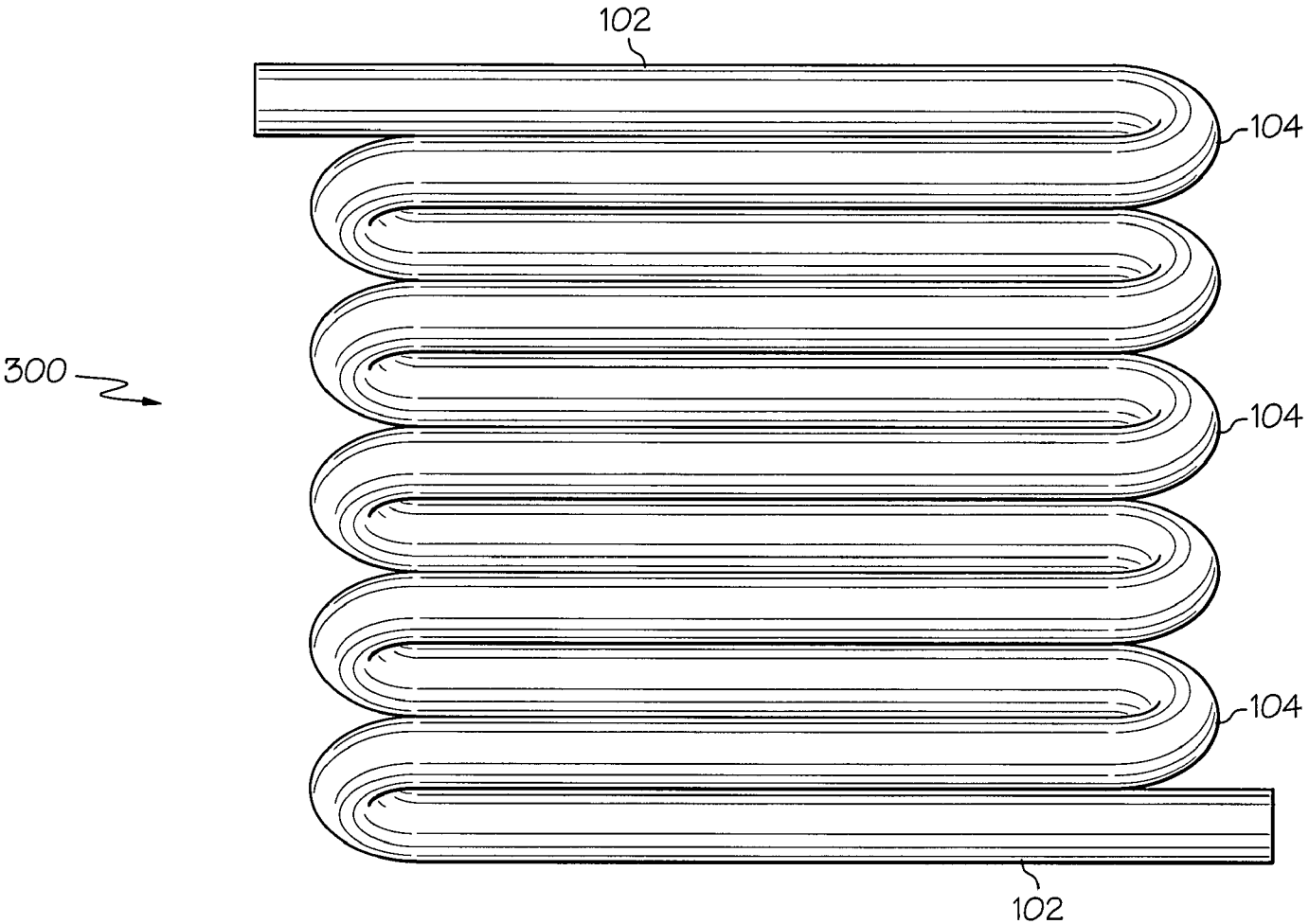
FIG. 7 is a front view of a second embodiment fluorescent lamp.
Figure 8:
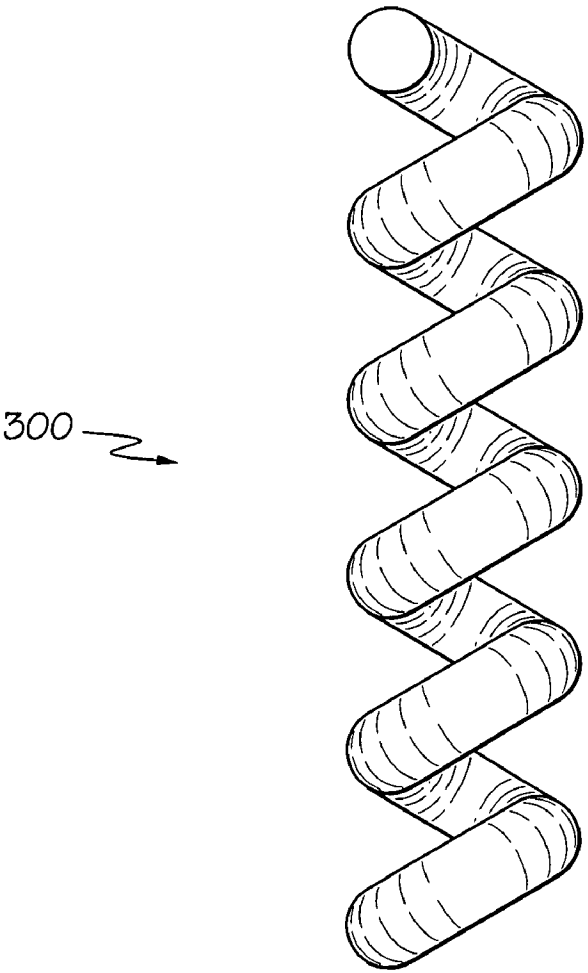
FIG. 8 is a side view of a second embodiment fluorescent lamp.
Figure 9:
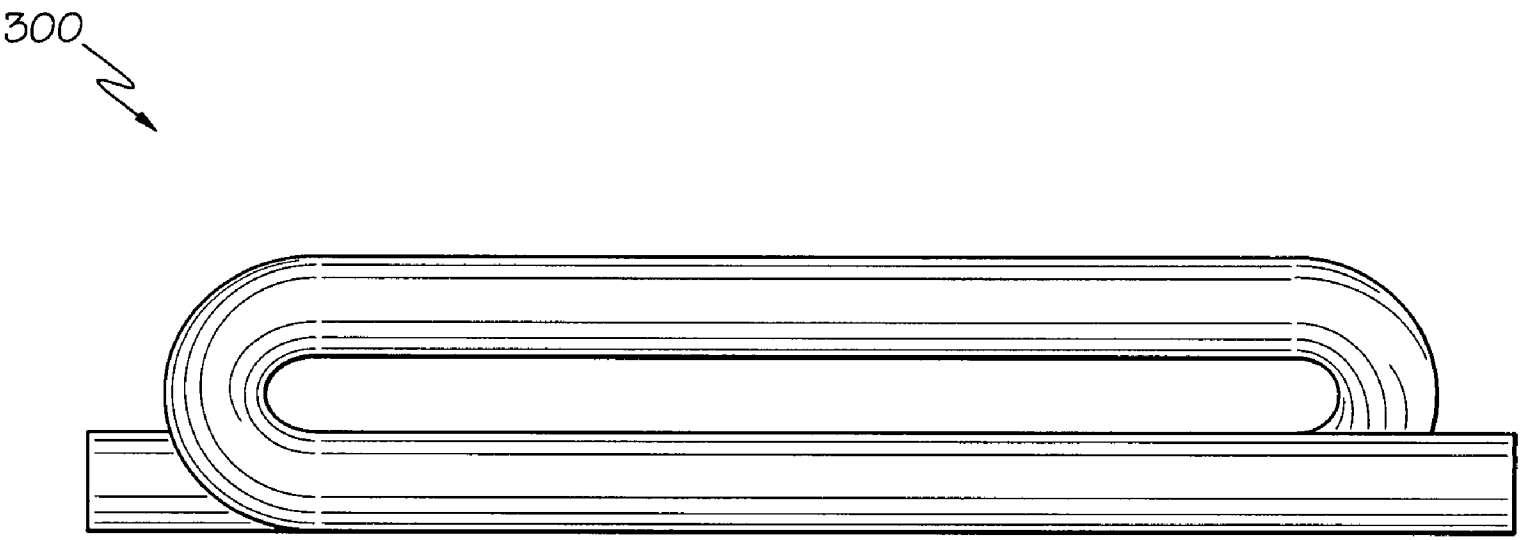
FIG. 9 is a bottom view of a second embodiment fluorescent lamp.
Figure 10:
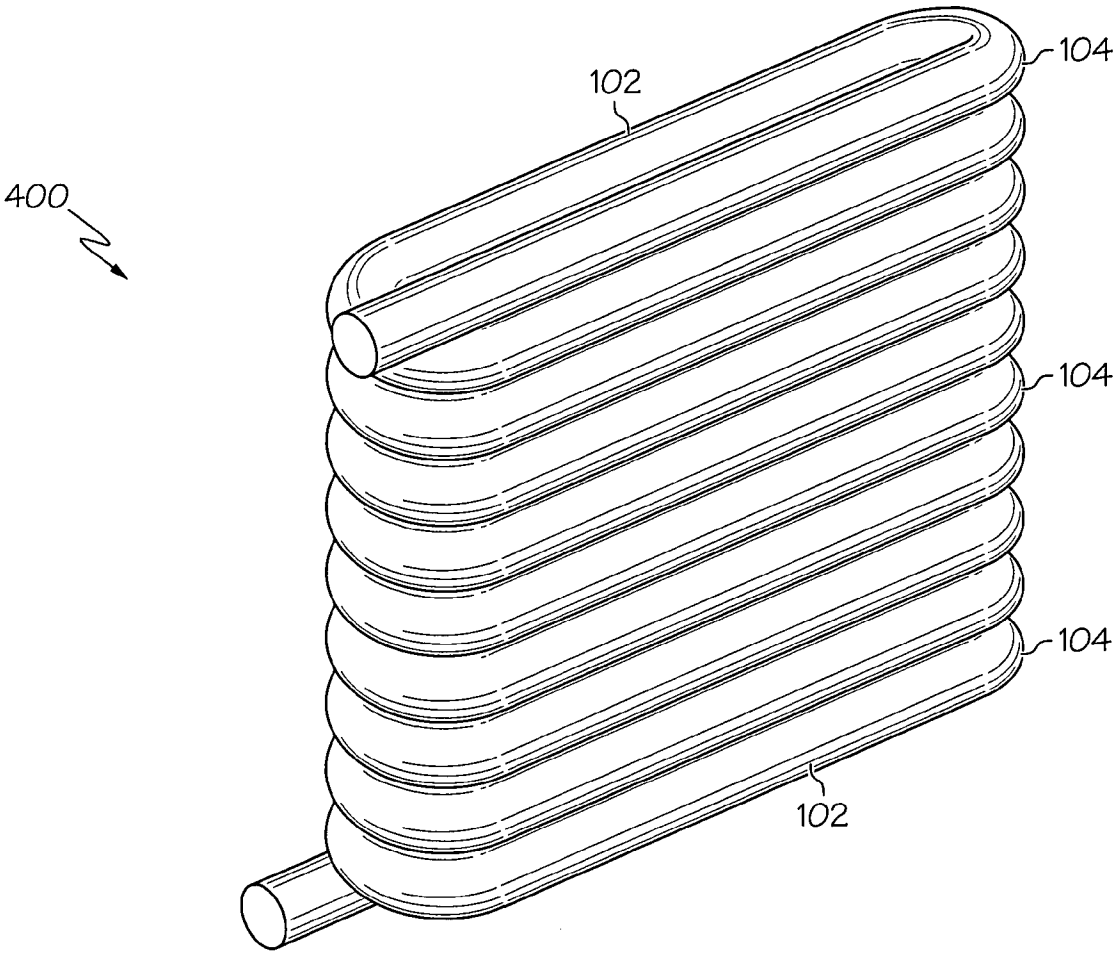
FIG. 10 is a perspective view of a third embodiment fluorescent lamp.
Figure 11:
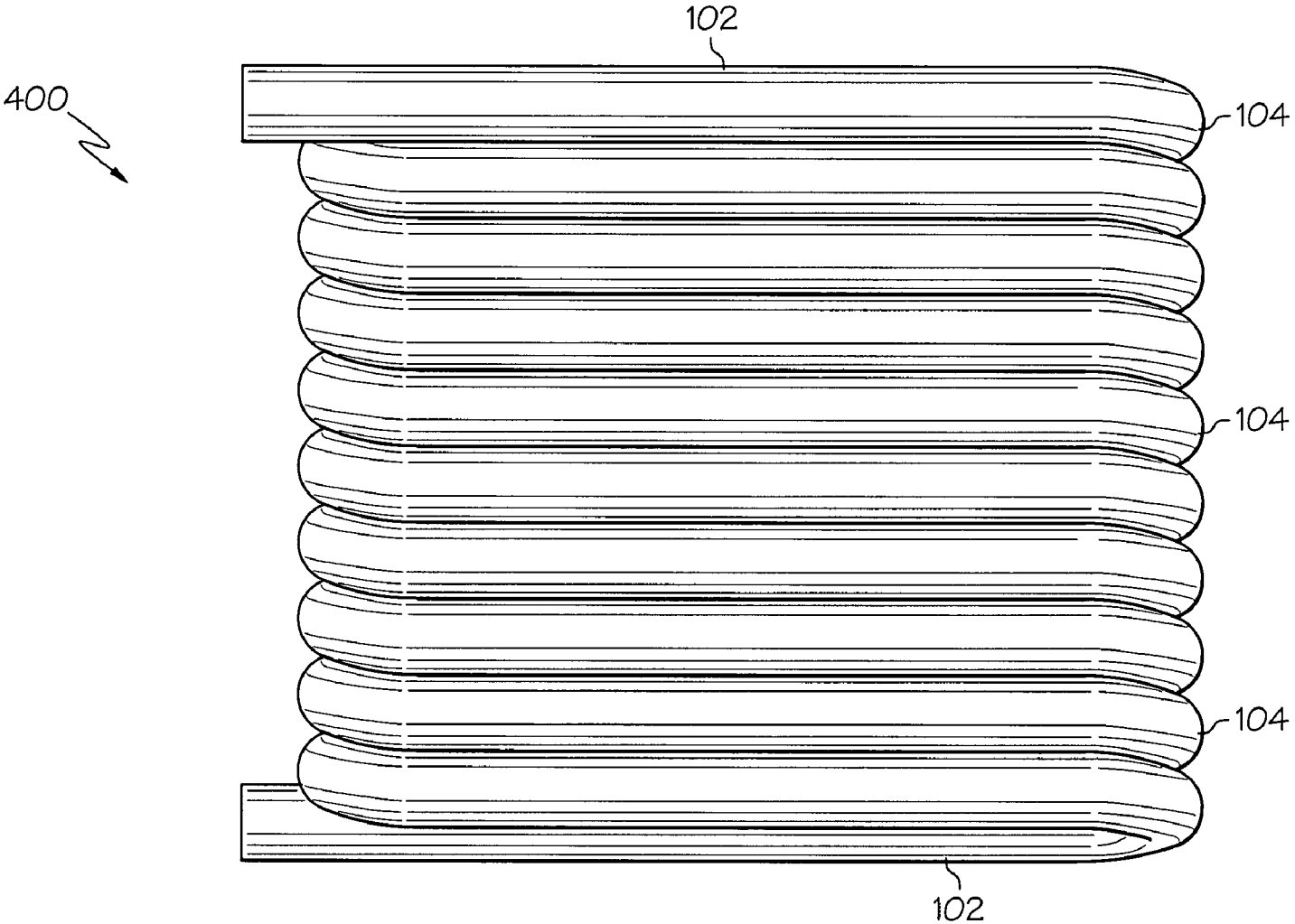
FIG. 11 is a front view of a third embodiment fluorescent lamp.
Figure 12:
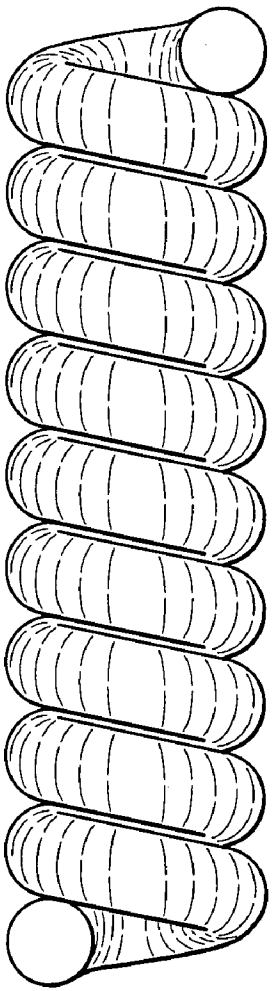
FIG. 12 is a side view of a third embodiment fluorescent lamp.
Figure 13:
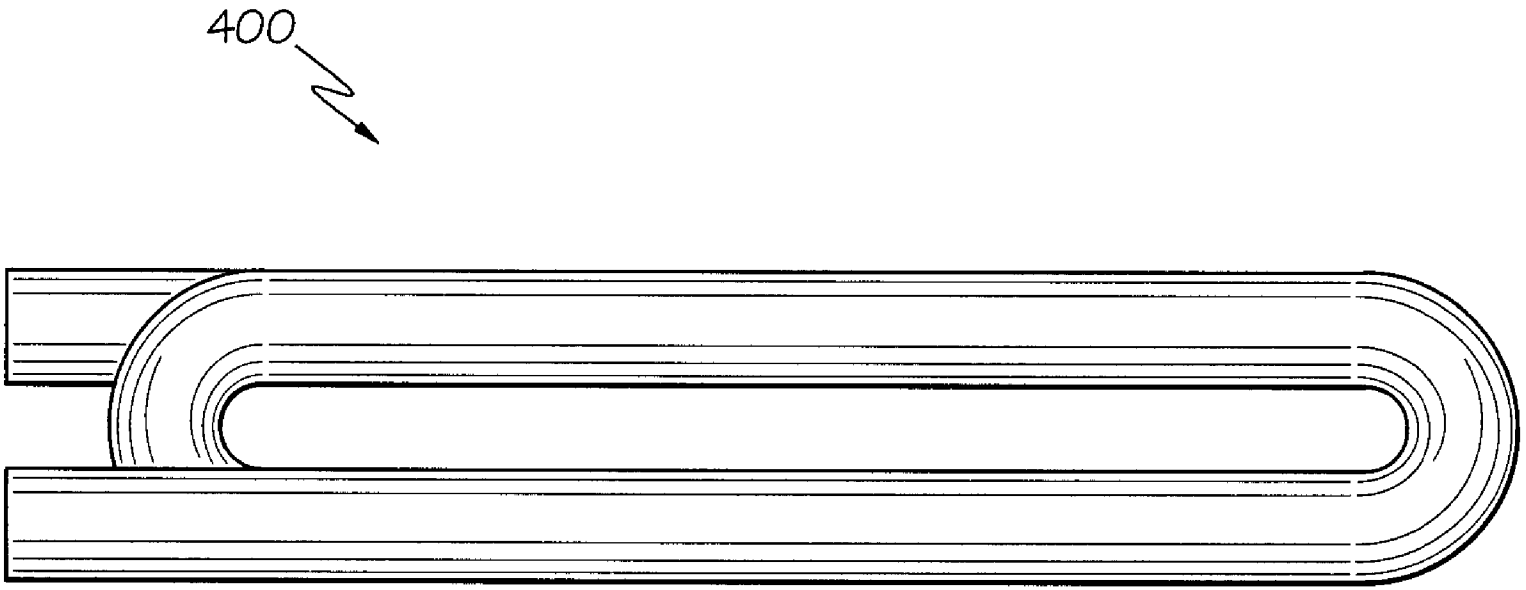
FIG. 13 is a bottom view of a third embodiment fluorescent lamp.
Figure 14:
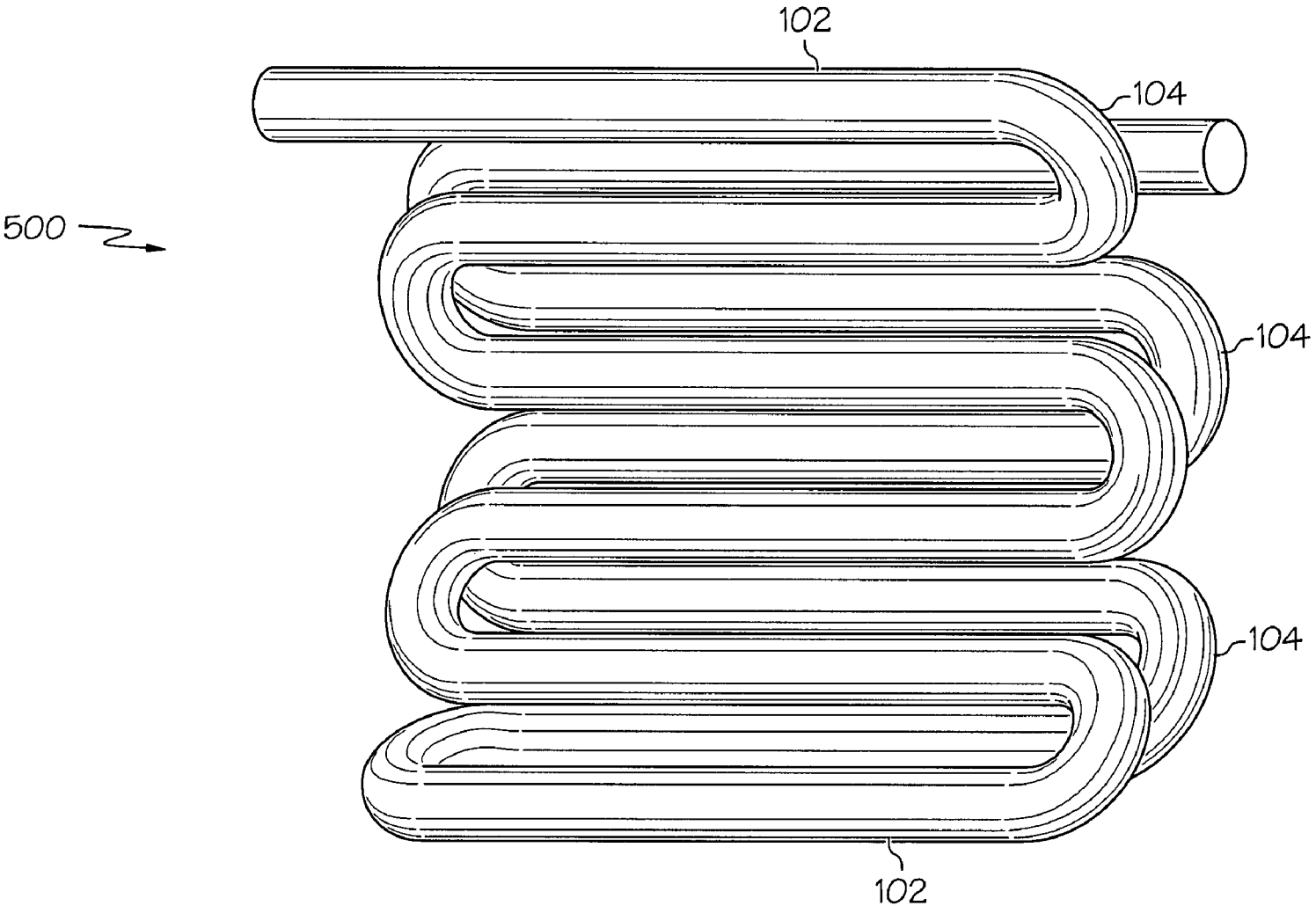
FIG. 14 is a perspective view of a fourth embodiment fluorescent lamp.

As can be seen from the front view illustrated in FIG. 7, the plurality of legs are spaced to provide a continuous lamp surface facing the front view of the lamp. This increased surface area can provide increased luminance in a relatively small sized lamp. This can be accomplished by spacing alternating successive legs apart a distance that is substantially equal to the diameter of the tube. Not shown in these figures are the cathodes, which would typically be placed at the ends of the tubular lamp. Like the first embodiment, this embodiment can be implemented as an aperture lamp.

Turning now to FIGS. 10, 11, 12 and 13, a perspective view, front view, side view and bottom view of a third embodiment fluorescent lamp 400 is illustrated. In this embodiment, the fluorescent lamp 400 again comprises a plurality of legs 102 and a plurality of curved segments 104. Like the third embodiment, the plurality of legs 102 is arranged such that successive legs in the plurality of legs alternate between a first plane and a second plane, with the first plane substantially parallel to the second plane. Furthermore, the plurality of legs 102 are arranged substantially parallel with each other. This embodiment differs from the second embodiment in that alternating successive legs are next to and adjacent each other, rather than being spaced as apart. This results in even more lamp volume being provided in an overall volume of the same amount. This can improve the brightness and reliability of the lamp. Again, not shown in these figures are the cathodes, which would typically be placed at the ends of the tubular lamp. Also, this embodiment, like the others can be implemented with aperture lamps.

Turning now to FIGS. 14, 15, 16 and 17 a perspective view, front view, side view and bottom view of a fourth embodiment fluorescent lamp 500 is illustrated. In this embodiment, the fluorescent lamp 100 comprises a plurality of legs 102 and a plurality of curved segments 104. The plurality of legs 102 is arranged such that a first set of legs resides in a first curve and a second set of legs resides in a second curve. In this embodiment, a first successive set of six legs is in the first curve, and a second successive set of five legs is in the second curve, with the first curve substantially parallel to the second curve.

Figure 15:
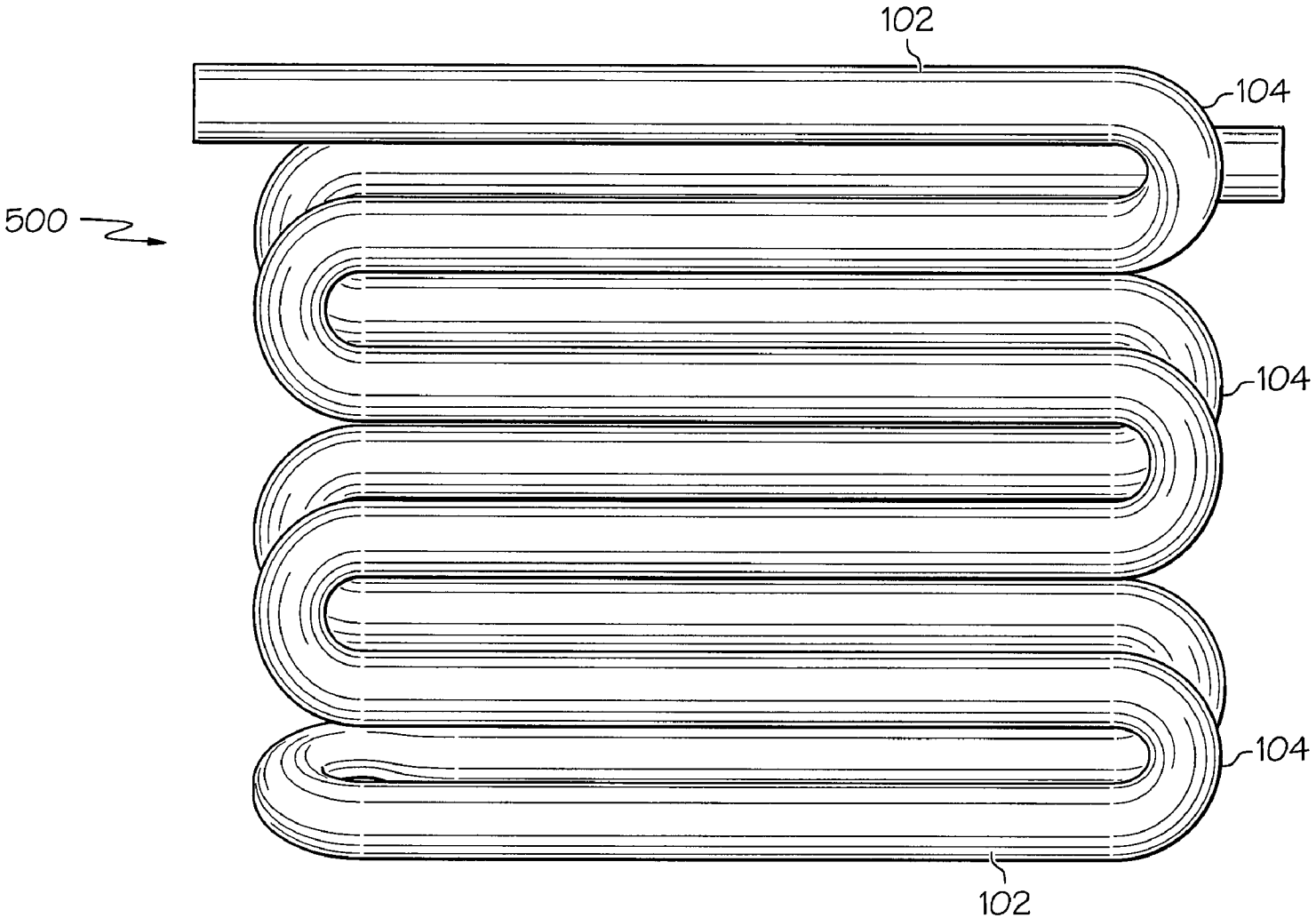
FIG. 15 is a front view of a fourth embodiment fluorescent lamp.
Figure 16:
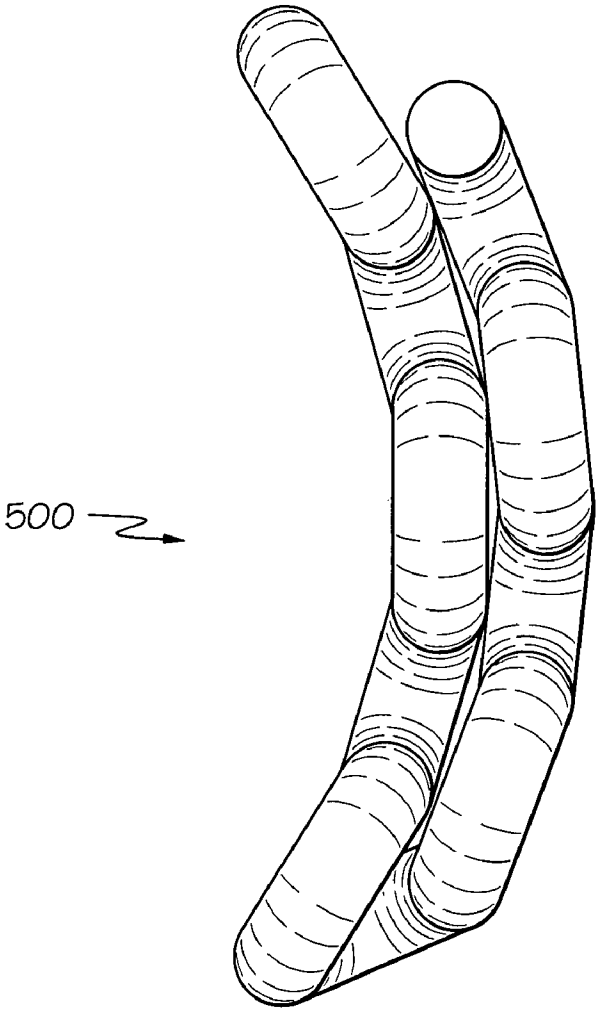
FIG. 16 is a side view of a fourth embodiment fluorescent lamp.
Figure 17:
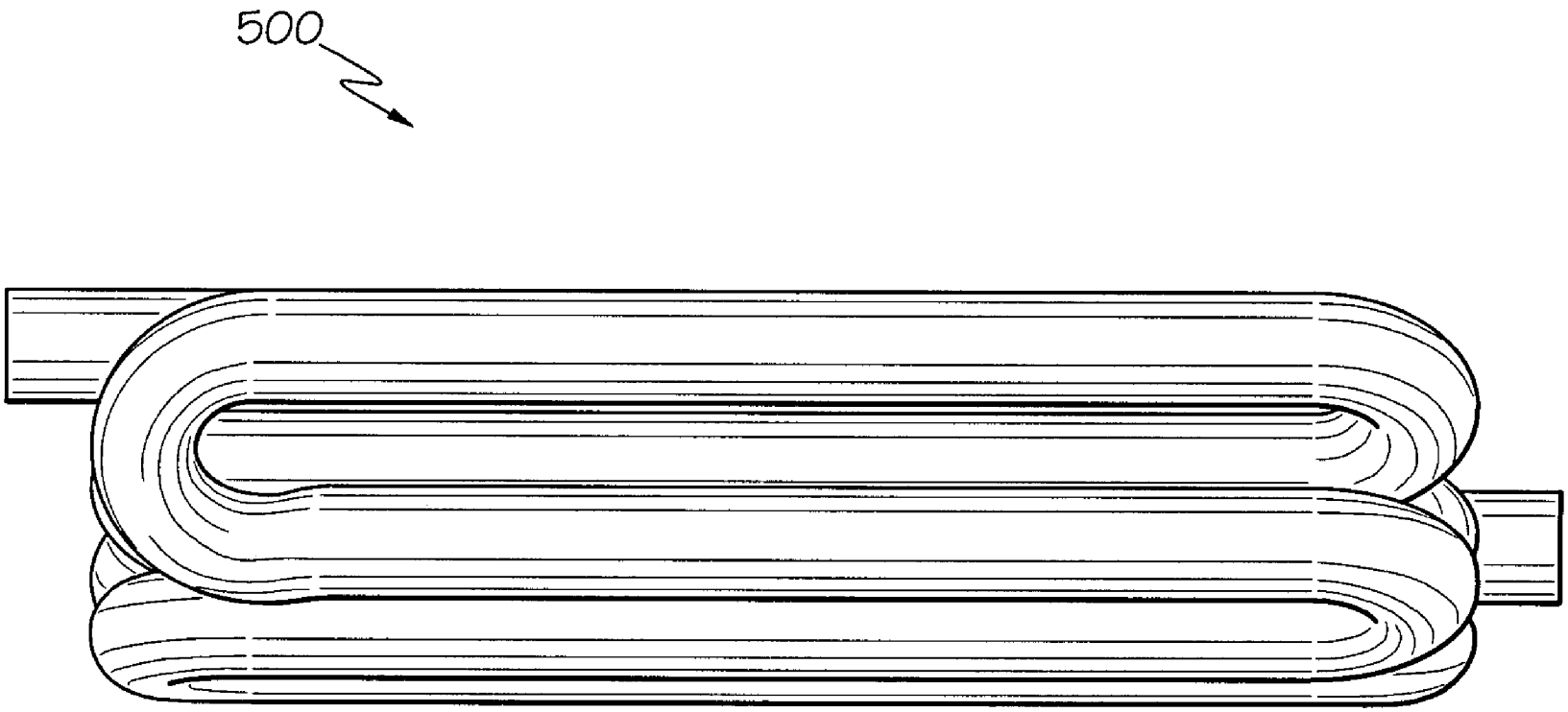
FIG. 17 is a bottom view of a fourth embodiment fluorescent lamp.

As can be seen from the front view illustrated in FIG. 15, the plurality of legs in the first curve are interdigitated with the plurality of legs in the second curve. This results a lamp structure that provides a continuous lamp surface facing the front view of the lamp. This increased surface area of the can provide increased luminance in a relatively small sized lamp. One curved segment serves as the transition segment between the legs in the first curve and the legs in the second curve. A lamp in this embodiment can be curved in this fashion to fill a particular shaped cavity and thus increase the surface area of the lamp that can be fitted in a cavity of that shape. Not shown in these figures are the cathodes, which would typically be placed at the ends of the tubular lamp. This embodiment, like the others can also be implemented with aperture lamps. It should also be noted that the embodiments illustrated in FIGS. 1–13 could also be implemented with curved planes of legs in the lamps.

Figure 18:
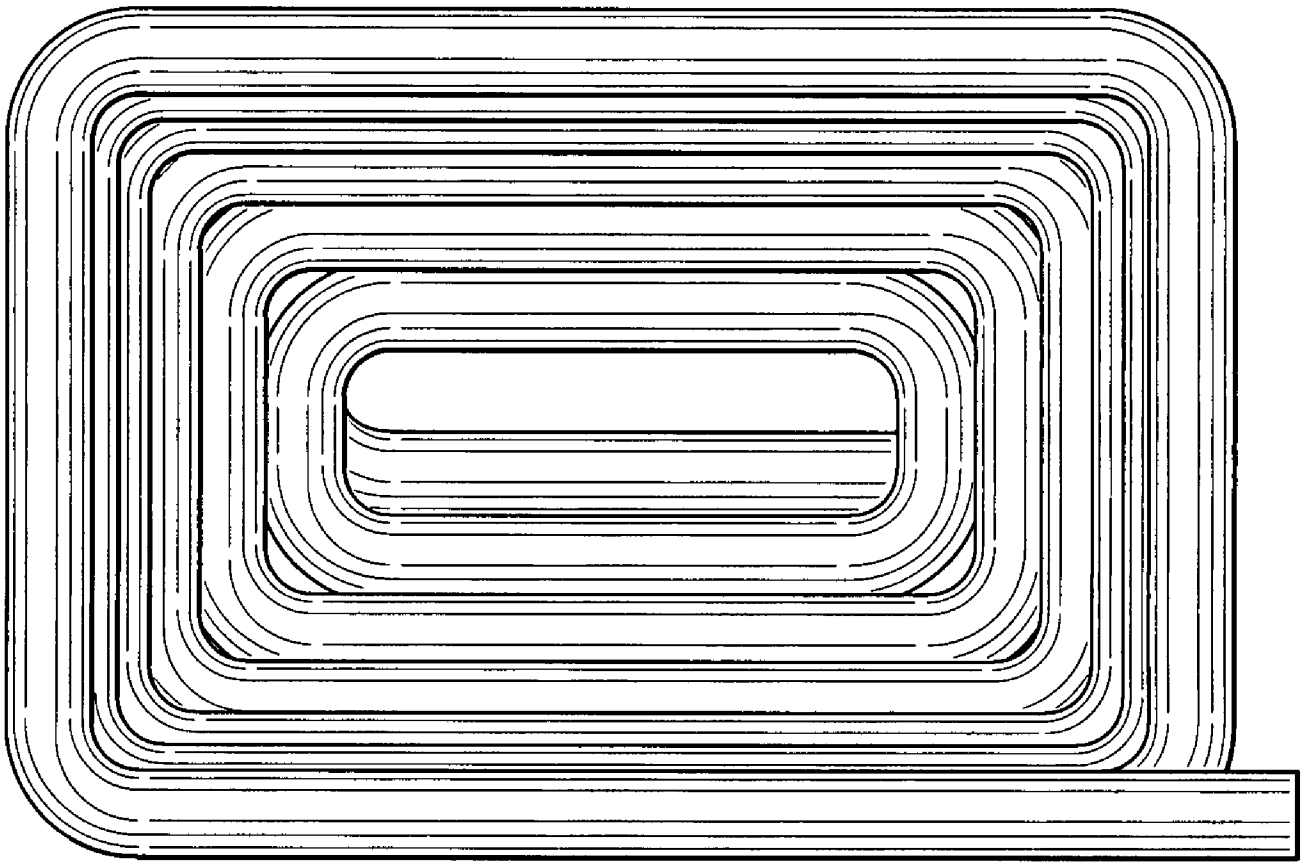
FIG. 18 is a front view of a fifth embodiment fluorescent lamp.
Figure 19:
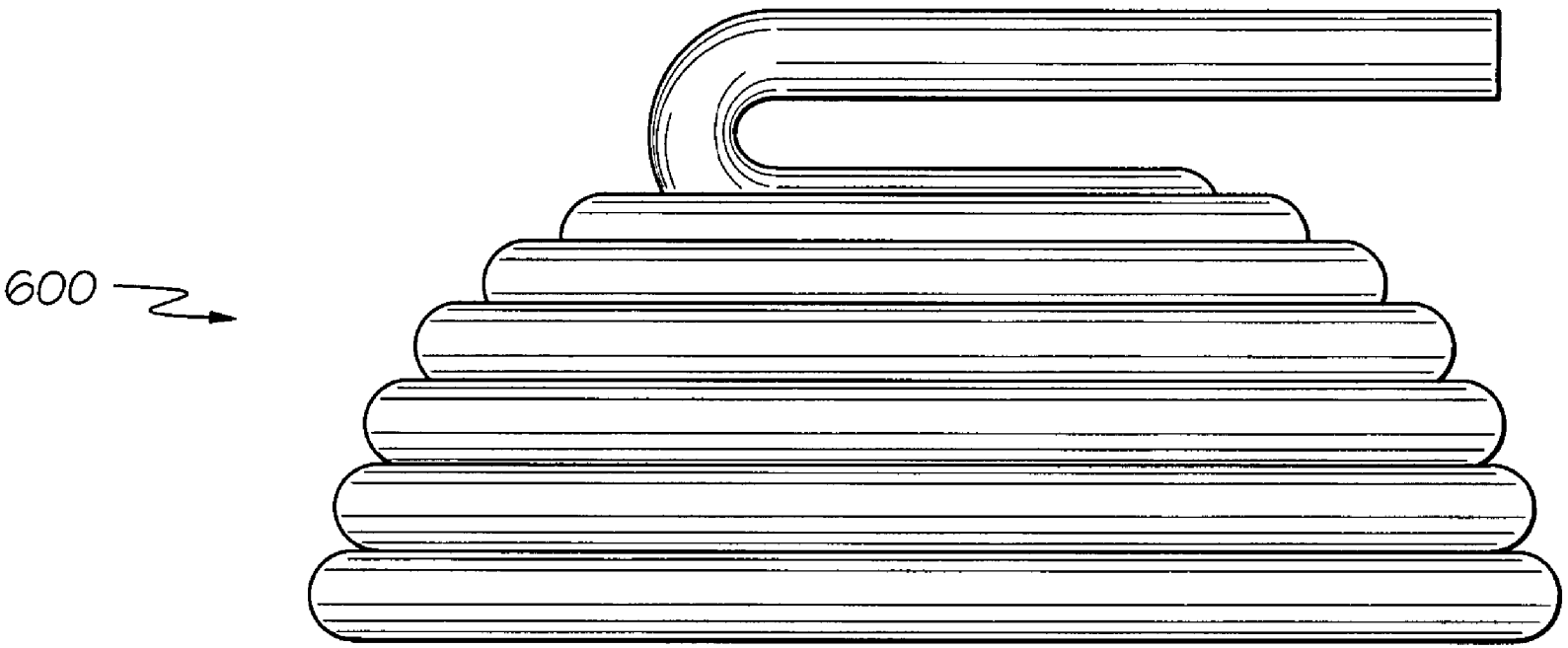
FIG. 19 is a first side view of a fifth embodiment fluorescent lamp.
Figure 20:
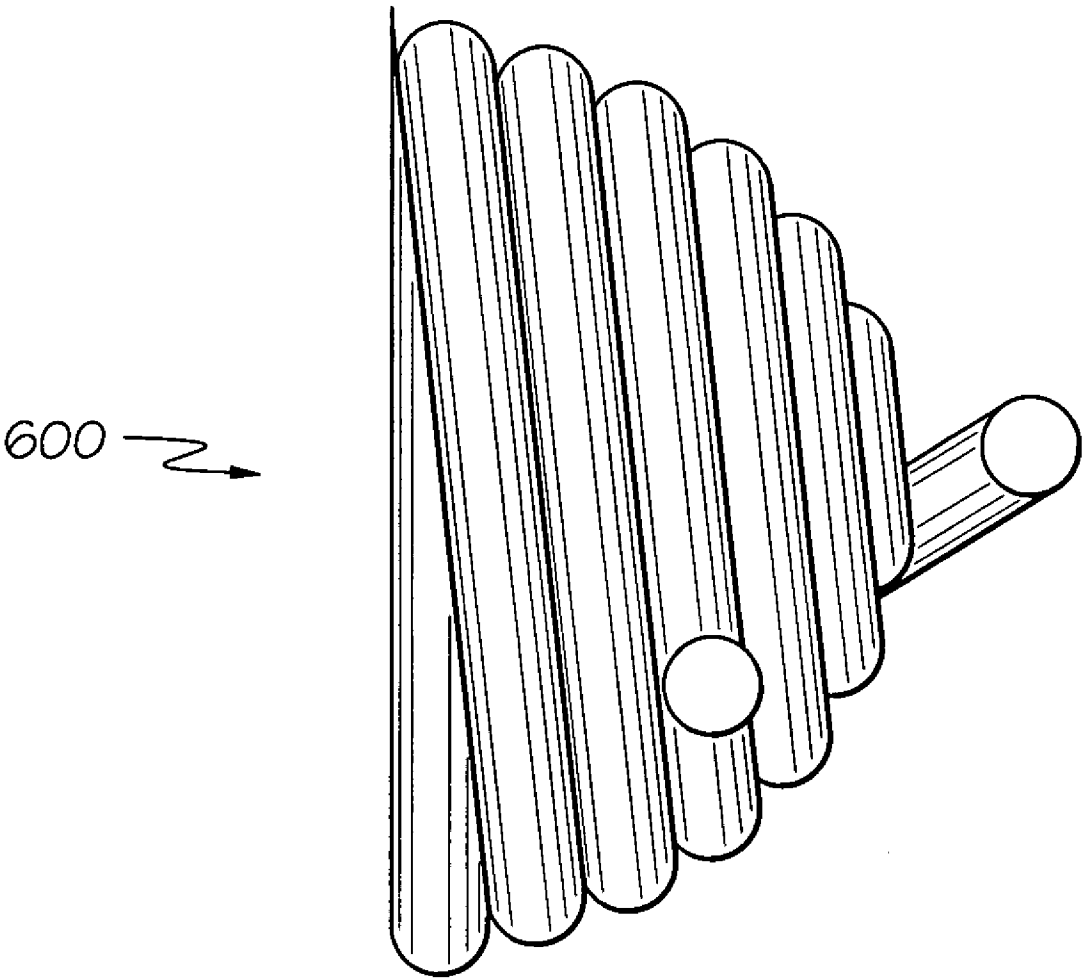
FIG. 20 is a second side view of a fifth embodiment fluorescent lamp.

Turning now to FIGS. 18, 19 and 20, a front and two side views of a fifth embodiment fluorescent lamp 600 is illustrated. In this embodiment, the fluorescent lamp 600 is arranged in a three dimensional serpentine coil. This embodiment, like the others, tightly winds the lamp to provide a large coil area in a relatively small volume. The shape of the serpentine coil allows the tubes to be tightly spaced without requiring sharp bends in the lamp that can be difficult to make. Like the other embodiments, the serpentine coil comprises a plurality of legs connected by a plurality of curved segments. The legs and segments are arranged to form the serpentine coil that fills the volume with lamp. Again, a lamp can be curved in this embodiment to better fill a custom-shaped cavity.

It should again be noted that the above five embodiments are not an exclusive list of the embodiments in which the present invention can be implemented. Furthermore, the embodiments described above can be implemented with many different variations.

As a first example, the legs and curved segments of the lamps can be formed in many different shapes. Generally, it is desirable to fill the available volume with lamp surface to increase lamp output and improve the life of the lamp. By changing the shape of the lamp, the lamp surface area can be increased for a given volume. As one example, the lamp is formed with various different cross sectional shapes designed to increase the lamp surface area.

Figure 21:
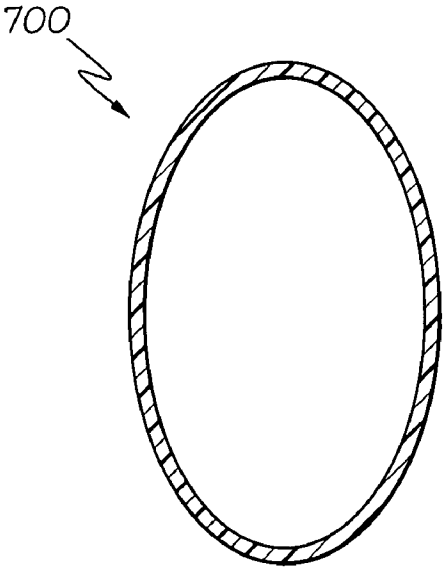
FIG. 21 is a cross sectional view of an elliptical lamp segment.

Examples of the different cross sectional shapes that can be used include elliptical and similar shapes. Turning now to FIG. 21, a cross sectional view of an elliptical lamp segment 700 is illustrated. Using an elliptical shaped cross section for one or more segments of the lamp can facilitate increased lamp surface area within the desired volume. Generally, the shape of the lamp would be configured such that the elliptical cross sectional fills the area facing the display. This increases the percentage of light output from the lamp that is directed toward the display and thus increases the efficiency of the device.

Additionally, the lamp segments can be formed with elliptical cross sections to provide a good surface for heat dissipation. Specifically, by orientating the long side of the elliptical lamp segment such that it is adjacent to a heat sink the percentage of heat absorbed by the heat sink can be improved. This can naturally improve the heat tolerance of the lamp and thus improve lamp reliability.

Figure 22:
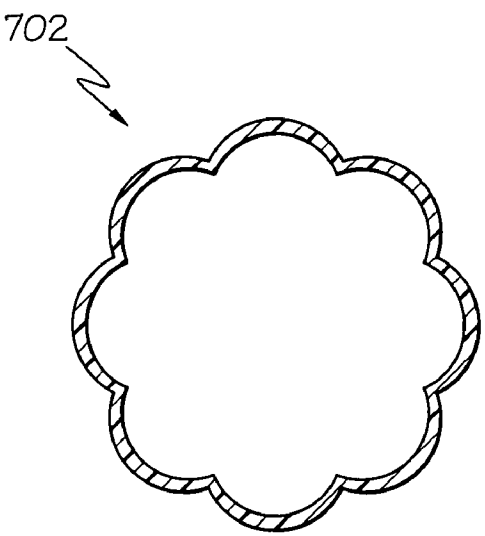
FIG. 22 is a cross sectional view of a scalloped lamp segment.

Another example of a different cross sectional shape that can be used for lamp segments is a scalloped shape. Turning now to FIG. 22, a cross sectional view of a scalloped lamp segment 702 is illustrated. The scalloped lamp segment 702 includes a plurality of protrusions, with each protrusion adding surface area to the lamp segment. The scalloped lamp cross section thus allows for an increased lamp surface area within the same overall volume. Thus, this embodiment can increase the output of the lamp. Again, it should be noted that these are just example of the types of cross sectional variations that can be used in the embodiments of the invention.

Figure 23:
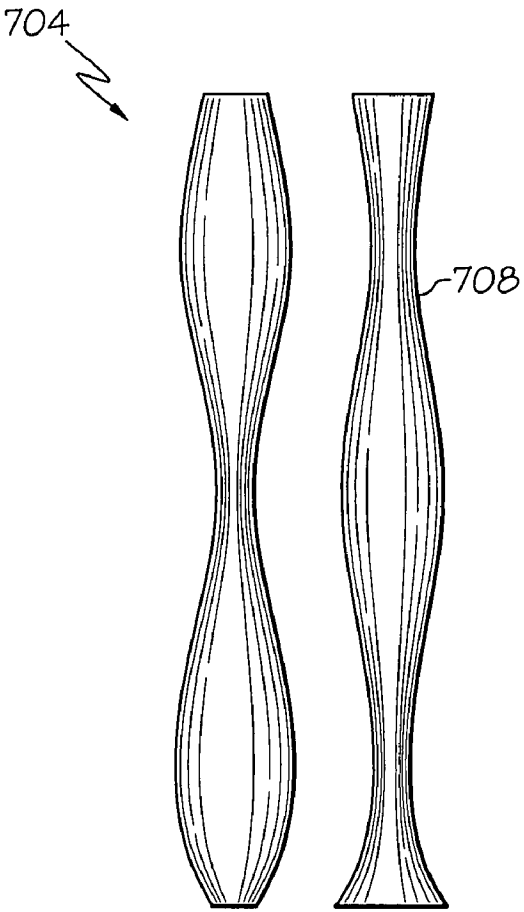
FIG. 23 is a side view of a lamp portion with variations in diameter.

In a further variation, the cross section on the lamp can vary along the length of the lamp. Turning to FIG. 23, a lamp portion 704 is illustrated where the lamp diameter varies along the length of the lamp. Specifically, lamp portion 704 shows portions of two adjacent legs 706 and 708. Each leg has variations in the diameter of leg, with these variations increasing the surface area of the lamp. As illustrated in FIG. 23, the variations in lamp diameter can be shaped to mesh with variations in lamp diameter of adjacent legs to more completely fill the available volume with lamp.

In addition to changing the cross sectional shape of each leg segment, the shape of the leg segments can be changed in other ways to increase lamp surface area. For example, legs can be shaped with various undulations that add additional surface area to the lamp. These undulations can be added to one more legs in the lamp depending upon the needs of the application. Furthermore, these undulations can shaped to allow adjacent legs to mesh with each other to more fully fill the available lamp area.

Figure 24:
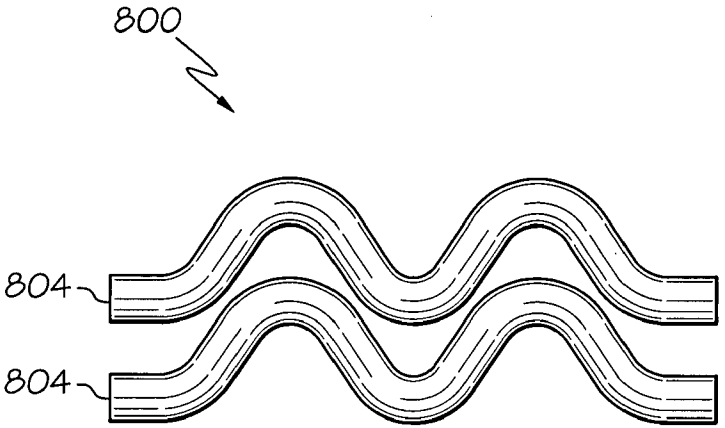
FIG. 24 is a bottom view of a lamp portion with undulations in adjacent legs.

Turning now to FIG. 24, a bottom view of a fluorescent lamp portion 800 is illustrated showing an embodiment where the legs 804 are undulated and meshed with adjacent legs to provide additional lamp surface area. These undulations allow high and low areas in the lamp leg to be nested, again providing more lamp surface area.

Figure 25:
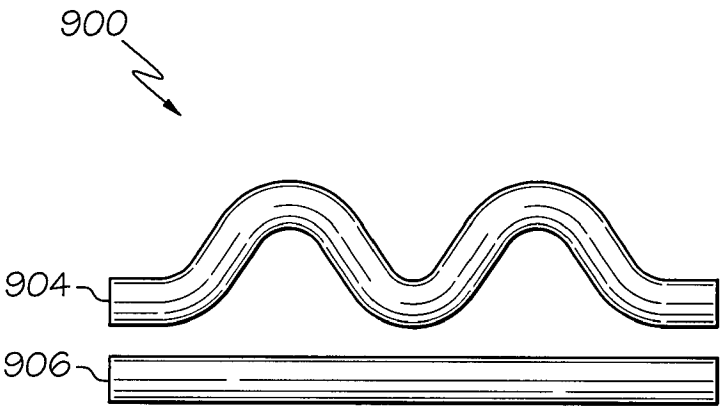
FIG. 25 is a bottom view of lamp portion with undulations in one leg and a straight other leg.

In some embodiments, it may be desirable to add undulations to legs in one plane legs in the other plane remain straight. This allows increased surface area in the one plane, while still providing a flat surface for the other plane. Keeping the legs flat in one plane can be desirable to provide a good surface to heat sink the lamp from. Turning now to FIG. 25, a bottom view of a fluorescent lamp portion 900 is illustrated where legs 904 in one plane are undulated and legs 906 in another plane are made straight. Again, this provides increased surface while also providing a good heat sink surface.

The embodiments described above and illustrated in FIGS. 1–25 and their variations can be used in a wide variety of applications such as LCD displays. One particular application is that of a LCD projection displays in general, and head up displays (HUDs) in particular. HUDs generally require a large range of brightness to make information clearly visible in a wide variety of ambient light conditions. For example, a HUD used in an avionics system will need to display information to the pilot under lighting conditions that can range from near total blackness to the extreme glare created by facing directly into daytime sunlight. Thus, a HUD used in an avionics system must have the ability to HUD a high brightness image. Without a sufficiently high brightness, a viewer of the display may be unable to easily read information from the display in high ambient light conditions. The embodiments illustrated in FIGS. 1–25 and their variations can be utilized in a HUD to provide the high luminance, in a compact size needed for an avionics projection display.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

The invention claimed is:

1. A tubular fluorescent lamp comprising:

a first plurality of legs and a first plurality of curved segments, each of the first plurality of curved segments arranged between a pair of the first plurality of legs, the first plurality of legs and the first plurality of curved segments arranged such that at least three successive legs in the first plurality of legs reside in a first plane; and a second plurality of legs and a second plurality of curved segments, each of the second plurality of curved segments arranged between a pair of the second plurality of legs, the second plurality of legs and the second plurality of curved segments arranged such that at least three successive legs in the second plurality of legs reside in a second plane different from said first plane, and wherein said second plane is substantially parallel with said first plane, and wherein the first plurality of legs is interdigitated with the second plurality of legs to create a continuous lamp surface along a first side of the fluorescent lamp, and wherein the first side is substantially parallel with the first plane.

2. The tubular fluorescent lamp of claim 1 wherein the first plurality of legs and second plurality of legs are substantially parallel.

3. The tubular fluorescent lamp of claim 1 wherein at least one of the first plurality of legs has a scalloped cross sectional shape.

4. The tubular fluorescent lamp of claim 1 wherein each of the plurality of legs includes an aperture facing the first side.

5. The tubular fluorescent lamp of claim 1 wherein at least one of the first plurality of legs has a cross sectional diameter that varies along a length of the at least one of the first plurality of legs.

6. The tubular fluorescent lamp of claim 1 further comprising a first cathode at a first end on the tubular fluorescent lamp and second cathode at a second end of the tubular fluorescent lamp.

7. A tubular fluorescent lamp comprising:

a first plurality of legs and a first plurality of curved segments, each of the first plurality of curved segments arranged between a pair of the first plurality of legs, the first plurality of legs and the first plurality of curved segments arranged such that at least three successive legs in the plurality of legs reside in a first curve; and a second plurality of legs and a second plurality of curved segments, each of the second plurality of curved segments arranged between a pair of the second plurality of legs, the second plurality of legs and the second plurality of curved segments arranged such that at least three successive legs in the second plurality of legs reside in a second curve different from said first curve, and wherein the first curve is substantially parallel to the second curve, and wherein the first plurality of legs in the first curve is interdigitated with the second plurality of legs in the second curve to create a continuous lamp surface along a first side of the fluorescent lamp.

8. The tubular fluorescent lamp of claim 7 wherein the plurality of legs are substantially parallel.

9. The tubular fluorescent lamp of claim 7 wherein at least one of the first plurality of legs has a scalloped cross sectional shape.

10. The tubular fluorescent lamp of claim 7 wherein each of the plurality of legs includes an aperture facing the first side.

11. The tubular fluorescent lamp of claim 7 wherein at least one of the first plurality of legs has a cross sectional diameter that varies along a length of the at least one of the first plurality of legs.

12. The tubular fluorescent lamp of claim 7 further comprising a first cathode at a first end on the tubular fluorescent lamp and a second cathode at a second end of the tubular fluorescent lamp.

* * * * *